US007028523B2

(12) United States Patent
Igelhorst et al.

(10) Patent No.: US 7,028,523 B2
(45) Date of Patent: Apr. 18, 2006

(54) RAILS FOR SUPPLYING MEDIA

(75) Inventors: Wolfgang Igelhorst, Mülheim (DE); Michael Minnerop, Ratingen (DE); Heidi Gebhardt, Wülfrath (DE); Siegmund Bulert, Wüppertal (DE); Wolfgang Schneider, Kreuztal (DE); Günter Heinrich, Hilchenbach (DE)

(73) Assignee: Sms Demag Aktiengesellschaft, Dusseldorf (DE)

( * ) Notice: Subject to any disclaimer, the term of this patent is extended or adjusted under 35 U.S.C. 154(b) by 196 days.

(21) Appl. No.: 10/380,748

(22) PCT Filed: Aug. 22, 2001

(86) PCT No.: PCT/EP01/09687

§ 371 (c)(1),
(2), (4) Date: Apr. 11, 2003

(87) PCT Pub. No.: WO02/24359

PCT Pub. Date: Mar. 28, 2002

(65) Prior Publication Data

US 2004/0035174 A1 Feb. 26, 2004

(30) Foreign Application Priority Data

Sep. 19, 2000 (DE) ..... 200 16 169 U

(51) Int. Cl.
*B21B 27/06* (2006.01)

(52) U.S. Cl. ..... 72/236; 72/237

(58) Field of Classification Search ..... 72/236, 72/237, 455; 184/6, 6.28
See application file for complete search history.

(56) References Cited

U.S. PATENT DOCUMENTS 3,646,790 A * 3/1972 Properzi ..... 72/43

FOREIGN PATENT DOCUMENTS

| | | | | |
|---|---|---|---|---|
| DE | 35 26 757 | * | 1/1986 | ..... 72/236 |
| DE | 196 16 551 | | 10/1987 | |
| DE | G9408440.8 | | 9/1994 | |
| JP | 54137464 | | 10/1979 | |
| WO | WO 99/52794 | | 10/1999 | |
| WO | WO 00/05005 | | 2/2000 | |

* cited by examiner

*Primary Examiner*—Lowell A. Larson
(74) *Attorney, Agent, or Firm*—Herbert Dubno

(57) ABSTRACT

The invention relates to a device which enables the actuators and consumers provided on a roll stand for rolling metallic and non-metallic strips to be supplied with operating media. The inventive device comprises a self-supporting construction module consisting of elements of variable which can be connected to each other, the height, width and depth of said elements being variable.

6 Claims, 2 Drawing Sheets

RAILS FOR SUPPLYING MEDIA

CROSS REFERENCE TO RELATED APPLICATIONS

This application is a national stage of PCT/EP01/09687 filed 22 Aug. 2001 and based upon German national application 200 16 169.5 of Sep. 19, 2000 under the International Convention.

FIELD OF THE INVENTION

The invention relates to an apparatus by means of which adjustment devices and drives on a rolling-mill frame used for rolling metallic and nonmetallic strip are supplied with fluids such as hydraulic fluid, compressed air, oil and grease lubricants, water, electricity, and the like.

BACKGROUND OF THE INVENTION

German utility model 94 08 440.8 describes how conduits for feeding fluids are formed by longitudinal bores in the support frame of the machine housing.

Here outlet ports of these longitudinal bores are covered with mounting plates for fluid connector fittings on the beam outer surface. In addition German utility model 94 08 440.8 describes how the longitudinal bores can be formed in separate plates serving as reinforcement.

International application WO 00/05005 proposes connecting all the supplied devices of a rolling-mill frame to a distribution network serving in particular for fluid media. The incoming and outgoing supply lines of the distribution network are grouped together in tubing-cluster modules on the rolling-mill frame. The control elements and valves are physically separate from the media-conducting column at a central location on the rolling-mill frame.

OBJECT OF THE INVENTION

It is an object of the present invention to minimize the amount of tubing in this type of apparatus, to optimally arrange the valves and control devices, to reduce the likelihood of leak-age, and to reduce manufacturing costs.

SUMMARY OF THE INVENTION

This object is attained by a self-supporting module comprised of connected-together elements and of variable height, width, and depth. The modules is constructed according to the positions of the control elements and drives in and on the rolling-mill frame. This is made possible in that elements of various dimensions are brought together and connected to one another. The lower elements are secured on the parts connected with the base. Above these the remaining elements are assembled in groups and connected together. The result of this piece-by-piece construction is a static unit that does not need to be mounted on the frame of the rolling stand and that can in fact stand on its own. The module is thus self-supporting. Providing the self-supporting module externally in front of the rolling-mill stand and using modular construction reduces leaks and fires as a result of the sealing of the individual submodules together and increases operational reliability.

According to the invention the self-supporting module can be provided with valve blocks and control devices. Conforming their orientation to the rolling-mill frame allows the valve blocks and control units to be mounted on the module optimally with respect to the controlled elements and drives of the roll frame. As a result of the closeness of the valve blocks and control units to the control elements and drives the lengths of the connections can be reduced. Shorter connections have a positive effect on the dynamics of control. As a result of the provision of the hydraulic and electrical element outside the inner region of the frame they are protected against the heat there.

According to the invention the self-supporting module can be provided with liquid reservoirs and electrical distributors.

The self-supporting module can be formed with longitudinally and/or transversely fully or partially throughgoing bores between liquid connectors or a liquid reservoir or an electrical distributor or a valve or a control device. These connecting bores connect the fluid connectors, liquid reservoirs, or electrical distributors with the valves or controlled elements.

The valves and control devices can be connected with the control elements or drives of the roll frame via hoses and/or tubing. As a result of the use of hoses or hoses and tubing there is less welding/soldering to be done.

The self-supporting module can be partially or fully premanufactured off site. The self-supporting module can be premade according to the known positions of drives and controlled elements of the roll frame. The premade self-supporting modules are premounted on and fitted to the roll frame as same is being put together in the shop. In this manner substantial assembly time is spared when the roll frame is being installed on site. The delivery and mounting of finished and tested units shortens the installation time. This allows the equipment to be put into use in a limited time frame.

According to a further embodiment of the invention a roll frame is provided with one or more of the self-supporting modules interconnected with flexible conduits. Flexible conduits are formed of individual movably assembled elements with internal hoses or electrical cables that are connected to premade connections points on the self-supporting module. The hoses or electrical cables that are used are longer than the maximum spacing of the self-supporting modules and permit some movement, even though the self-supporting modules are connected to one another.

BRIEF DESCRIPTION OF THE DRAWING

Further embodiments of the invention are shown in the drawing and described in the following. Therein.

Figure 1:
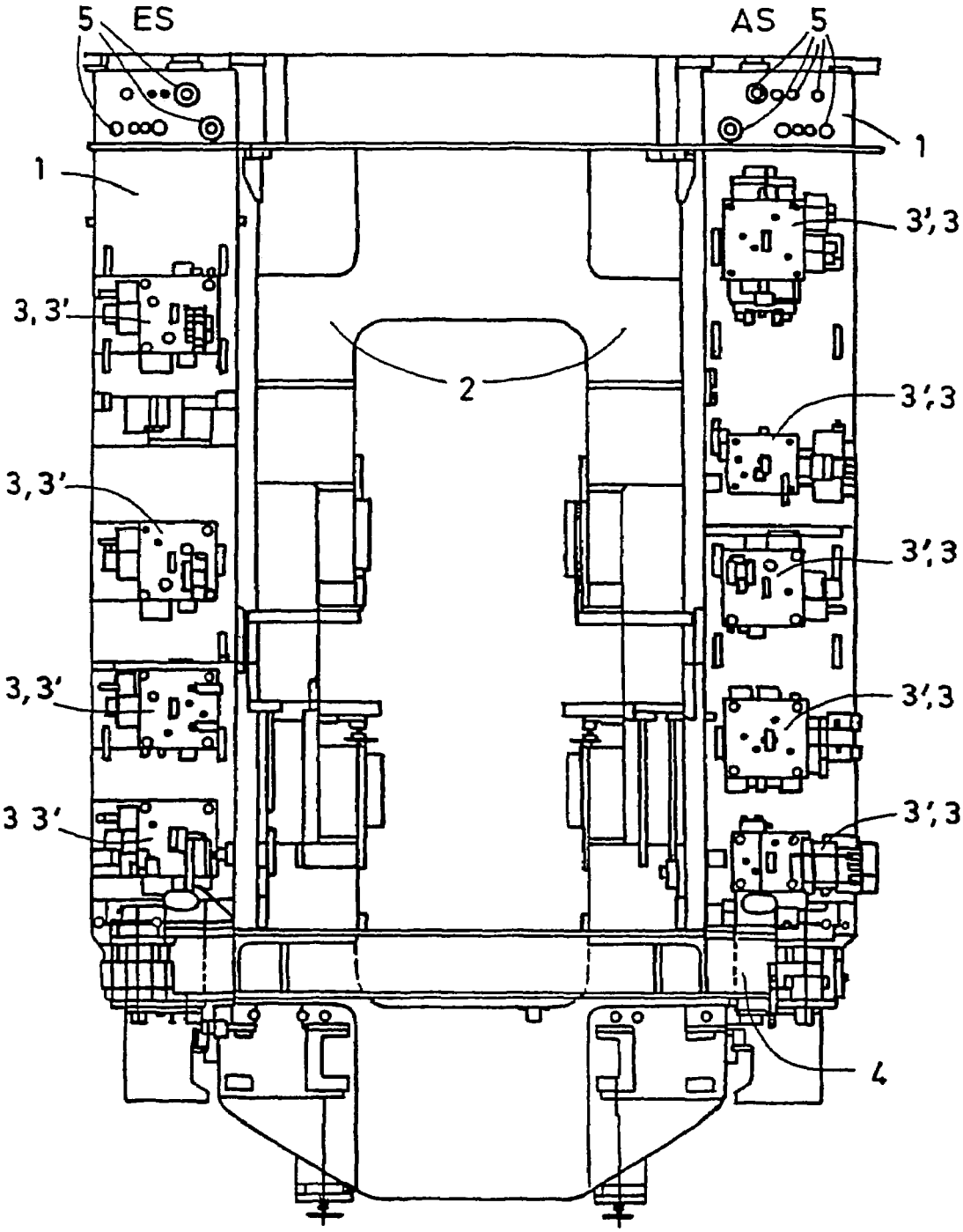
FIG. 1 is a schematic front view of a roll frame of a roll stand not shown in further detail with two self-supporting modules.

In the embodiment according to FIG. 1 at the upstream and downstream sides of a rolling-mill frame shown in detail there are different self-supporting modules 1. The self-supporting modules 1 are mounted vertically on a base 4 near roll-frame columns 2. The self-supporting modules 1 are differently constructed according to the actual positions of drives and control devices of the rolling frame. As a result of this different construction of the upstream and downstream self-supporting modules 1, valve blocks 3' and control devices 3 are mounted on the self-supporting construction module 1 at locations optimized for the respective drives and controlled elements. The connection of the upstream unit to the downstream unit is via unillustrated connections secured at 5 to the upstream and downstream units.

Figure 2:
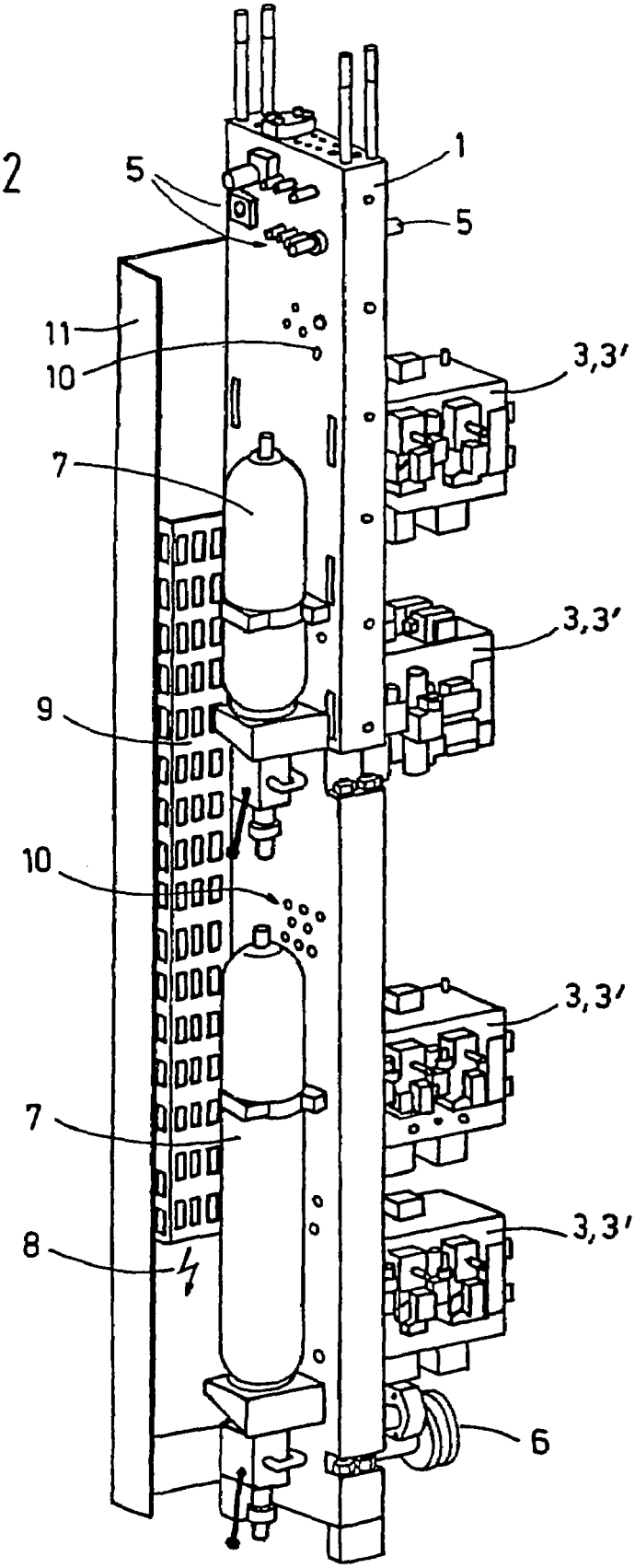
FIG. 2 is a perspective view from behind of a single self-supporting module.

A further embodiment of the self-supporting module 1 is shown in detail in FIG. 2. As in FIG. 1 the valve blocks 3' and control devices 3 are differently constructed and arranged at respective optimal mounting locations for the respective drives and controlled elements of the roll frame on the self-supporting module 1. Fluid connectors 6 here are adjacent the base. With the perspective view one fluid connector 6 is shown, other possible fluid connectors not being visible. A shield plate 11 on the back side of the self-supporting module 1 covers liquid reservoirs 7, electrical distributors 8, and various cable conduits 9. Further throughgoing transverse bores 10 are shown extending through the self-supporting module 1. Control cables for the control units 3 or cables for supplying electricity to the valve blocks 3' and control devices extend through these transverse bores 10.

Connecting conduits extend from and to the liquid reservoirs 7 through transverse bores 10 to the valve blocks 3' or control devices 3 on the front side. The upper region of the self-supporting module 1 has the connectors 5 (see FIG. 2) for flexible conduits for connecting together several self-supporting modules 1.

FIGS. 1 and 2 do not show the longitudinal and transverse connecting bores between fluid connectors or liquid reservoirs and valves or control units that extend partly or all the way through the self-supporting module 1. In addition there is no showing of the control elements and drives of the roll frame.

The invention claimed is:

1. In combination with a rolling-mill stand having a rolling-mill frame with respective columns, an apparatus for supplying media in the form of electricity and fluids including hydraulic fluids, compressed air, lubricants and water to adjustment devices and drives of the rolling-mill stand, said apparatus comprising:

a free-standing and self-supporting module juxtaposed with one of said columns and formed of a plurality of block-shaped elements of various heights, widths and depths stacked one upon another and provided with connections between them for passing said media, a lowermost one of said elements being mounted on a base adjacent said rolling-mill stand, the others of said elements being stacked upon said lowermost element and one another;

at least one valve block on at least one of said elements communicating with said stand; and at least one control device on at least one of said elements connected with said stand.

2. The apparatus defined in claim 1 further comprising at least one liquid reservoir and at least one electrical distributor provided on said module.

3. The apparatus defined in claim 2 wherein said module is formed with longitudinal and transverse bores between liquid connectors and said valve block and control device.

4. The apparatus defined in claim 3 wherein said valve block and said control device are connected with the respective column by hoses.

5. The apparatus defined in claim 1 wherein said module is at least partially manufactured off site.

6. The apparatus defined in claim 1 wherein said rolling mill stand has a plurality of said modules interconnected by flexible conduits.

* * * * *